US005671614A

United States Patent [19]

Shima

[11] Patent Number: 5,671,614

[45] Date of Patent: Sep. 30, 1997

[54] APPAREL SYSTEM AND A LILY YARN MACHINE USABLE TO IT

[75] Inventor: Masahiro Shima, Wakayama, Japan

[73] Assignee: Shima Seiki Manufacturing Ltd., Wakayama, Japan

[21] Appl. No.: 645,708

[22] Filed: May 14, 1996

[30] Foreign Application Priority Data

May 19, 1995 [JP] Japan ..... 7-145255

[51] Int. Cl.[6] ..... D04B 15/00

[52] U.S. Cl. ..... 66/13; 66/34; 66/125 A

[58] Field of Search ..... 66/1 R, 9 A, 34, 66/62, 125 A, 211, 231, 13

[56] References Cited

U.S. PATENT DOCUMENTS

| | | | |
|---|---|---|---|
| 587,026 | 7/1897 | Voelker | 66/125 A |
| 1,081,179 | 12/1913 | Wildman | 66/34 |
| 1,260,954 | 3/1918 | Bauer | 66/34 |
| 2,247,716 | 7/1941 | Schellenberg et al. | 66/125 A |
| 3,759,024 | 9/1973 | Colton | 66/125 A |
| 3,774,412 | 11/1973 | Schichman | 66/125 A X |
| 3,952,552 | 4/1976 | Rozner | 66/125 A |
| 3,995,450 | 12/1976 | Rozett | 66/1 R X |
| 4,335,588 | 6/1982 | Bos | 66/125 A |
| 5,073,984 | 12/1991 | Tone et al. . | |
| 5,268,210 | 12/1993 | Iijima . | |
| 5,369,966 | 12/1994 | Morita et al. | 66/132 |

FOREIGN PATENT DOCUMENTS

| | | | |
|---|---|---|---|
| 3152455 | 6/1988 | Japan | 66/125 A |
| 6-30188 | 4/1994 | Japan . | |

OTHER PUBLICATIONS

Public Debut for Macotex User-Twist at Kovo Exhibition, The Hosiery Trade Journal, vol. 77 No. 913, Jan. 1970, pp. 70, 72, 75.

A. New Concept in Yarn Control (and Patterning, Dr. Harry Wignall, Knitting Times Yearbook, vol. 46, No. 18, Apr. 1977, pp. 117–119.

*Primary Examiner*—John J. Calvert

*Attorney, Agent, or Firm*—Nikaido, Marmelstein, Murray & Oram LLP

[57] ABSTRACT

An apparel system includes a lily yarn machine for knitting lily yarns, and a flat knitting machine having at least two needle beds for knitting according to knitting data. A controller is connected to the lily yarn machine and the flat knitting machine for controlling the lily yarn machine to produce a lily yarn in a quantity which is required by the flat knitting machine according to the knitting data for the flat knitting machine.

9 Claims, 7 Drawing Sheets

APPAREL SYSTEM AND A LILY YARN MACHINE USABLE TO IT

FIELD OF THE INVENTION

The present invention relates to an apparel system using a knitting machine such as a flat knitting machine or a sewing machine such as a cording machine, and in particular, an apparel system which produces yarns or cords for cording in the form of work threads or yarn known as lily yarns within the system to simplify the inventory management of yarns. The present invention also relates to a lily yarn machine to be used in the above-mentioned system.

PRIOR ART

It is necessary for apparel systems to procure yarns according to their production plan. In the case of knitting, for example, the kinds of knitting yarns are determined by the kinds of knitting fabrics to be produced and the kinds of yarns to be used for the respective knitting fabrics. The particulars that determine the kind of knitting yarn are colors and texture, namely, the bulkiness of the yarn, the degree of hardness or softness of the yarn, the weight per unit length of the yarn, and sensory elements such as tactile feeling. The required total quantities of knitting yarns are determined by the usages of respective yarns for each knitting fabric and the production plan of the respective knitting fabrics. The usage of a knitting yarn for each knitting fabric can be obtained from the knitting data thereof. When plural knitting yarns are used for one knitting fabric, the usages of the respective knitting yarns can be determined from the knitting data thereof. Many kinds of knitting yarns are required for knitting, and if one can not procure these knitting yarns, the production will be halted. If the order for a knitting yarn is excessive, it will result in an inventory, which may be left over to the next season except the staple or basic yarns. Even if the time between the placement of orders for knitting yarns and the delivery thereof is short, one can not proceed to the actual production, thus a certain time is required between the designing stage and the startup of the actual production. Management of yarns, therefore, is one important factor for the apparel system.

With regard to the relevant prior art, the applicant proposed, in the Japanese Provisional Patent Publication Hei-6-2250, to provide a knitting machine with a yarn processing machine such as a knotter to change over from one yarn to another of plural cones of yarns. This patent discloses that the carriage position of a knitting machine and the yarn length per loop are monitored to change over from one yarn to another at desired timings such as transition points of patterns. The patent also discloses that yarns are provided with some redundancies and the redundant portions of the yarns are knitted into waste courses to produce desired patterns.

Next, the lily yarn machine itself is in the public domain as described in the Japanese Utility Model Provisional Publication Hei-6-30188 and the Japanese Patent Sho-51-2980, and the lily yarn machine knits a single yarn or plural yarns into a form of cord to produce a lily yarn. These prior arts, however, have not considered alteration of the texture of a lily yarn.

SUMMARY OF THE INVENTION

The basic task of the present invention is to provide an apparel system which requires no inventory management of yarns and produces lily yarns from a small number of raw yarns within the system to use them (Claims 1 through 9).

Another task of the present invention is to provide a lily yarn machine suited to the above-mentioned apparel system.

The present invention comprises an apparel system which is provided with a lily yarn machine for knitting lily yarns, a knitting machine for knitting according to knitting data or a sewing machine for sewing according to sewing data, and a controller for controlling said lily yarn machine to produce lily yarn in a quantity required by said knitting machine or said sewing machine according to said knitting data for said knitting machine or said sewing machine according to said sewing data. Said knitting machine may be a flat knitting machine as shown in the embodiment, a circular knitting machine, a warp knitting machine, a glove knitting machine, hosiery machine, etc., and a flat knitting machine that is suited to production of varied products in small quantities is particularly preferred. Said sewing machine may be a embroidery machine, and lily yarns may be used as cords for cording. Preferably, a reservoir of lily yarn is provided, one end thereof is connected to said lily yarn machine and the other end thereof is connected to said knitting machine to directly connect said lily yarn machine and said knitting machine and integrate the operations of both the machines. Preferably, means are provided for detecting the reserved length of the lily yarn in said reservoir and a means for controlling the knitting speed of said knitting machine according to the reserved length thus determined.

Preferably, a dyeing machine for dyeing raw yarns for lily yarn is provided, and said dyeing machine is operated by a controller according to sewing data or knitting data to dye raw yarns. Preferably, the knitting machine or the sewing machine is provided with a sensor for detecting the colors of the lily yarn.

Preferably, the lily yarn machine is provided with a means for controlling texture to control the texture of the lily yarn. Preferably, the means for controlling texture comprises a means for raising and lowering a sinker cam and a needle cam for controlling sinkers and needles provided along a virtually conical cylinder of the lily yarn machine along the cylinder.

The present invention also comprises a lily yarn machine wherein a virtually conical cylinder having a cavity therein is provided, plural needles and sinkers are arranged along the outer surface of said cylinder, said needles are controlled by a needle cam and said sinkers are controlled by a sinker cam, said cylinder and said needle cam and said sinker cam are rotated relatively to each other by a rotating means, and a means for raising and lowering said sinker cam and said needle cam along said outer surface is provided. Preferably, said needles are comprised of compound needles, each compound needle comprising a needle stem and a slider, and said needle cam is provided with a slider cam for controlling said sliders.

According to the present invention, a lily yarn machine is combined with a knitting machine or a sewing machine, the required quantity of lily yarn is determined from knitting data or sewing data to control the lily yarn machine, the lily yarn is produced from a small number of raw yarns on the spot, and the lily yarn is fed to the knitting machine or the sewing machine. This eliminates the need of inventory management of yarns, and one can proceed to the actual production without waiting for the procurement of yarns. Thus it allows easier production of varied products in small quantities.

When the production speed of the lily yarn of the lily yarn machine is low relative to the knitting speed of the knitting machine, a reservoir for lily yarn, for example, may be provided inbetween, and one end thereof is connected to the lily yarn machine and the other end thereof is connected to the knitting machine. Another or more components may be placed between the reservoir and said knitting machine and/or said lily yarn machine. In this way, smooth production of knitting fabrics can be achieved even if the production speed of the lily yarn and the knitting speed of the knitting machine do not fit to each other.

If the reserved length of the lily yarn in the reservoir is measured to control the knitting speed of the knitting machine, smooth knitting can be achieved without yarn breaks or the like.

If a dyeing machine is provided to dye raw yarns for lily yarn, varied yarns for knitting, cords for cording, etc. can be produced on the spot. Thus lily yarns of varied colors can be produced on the spot from a small number of raw yarns. Moreover, errors in dyeing positions are not conspicuous, and beautiful knitting fabrics or beautiful embroideries are produced. When raw yarns are dyed, the errors in dyeing positions are not conspicuous because the raw yarns are longer than the lily yarns.

When the knitting machine or the sewing machine is provided with a sensor for detecting the color of the lily yarn, the system can control the knitting machine while monitoring the color of the actual lily yarn, thus the system can knit fabrics of varied colors with exact color patterns using a single raw yarn.

Plural raw yarns of varied materials produced from various raw materials such as cotton, wool and polyester may be used and joined by a knotter to be fed into the lily yarn machine. In this case, knots produced by the knotter in the yarn will not be conspicuous when the yarn is knitted into a lily yarn. As a matter of course, a dyeing machine and a knotter may be used together. According to this arrangement, the knotter makes it possible to change the material of the lily yarn according to, for example, the position in the knitting fabric, embroidered portion, etc.; variations in design can be enhanced. The texture of the lily yarn, such as the yarn count, can be controlled with the means for controlling texture, colors can be changed by the dyeing means, and the material can be changed by changing the raw yarn of the lily yarn with the knotter.

To knit varied fabrics from a small number of raw yarns, preferably, the lily yarn machine is provided with a means for controlling texture that allows modifications in bulkiness, feeling to touch such as hardness and softness, and visual factors of the lily yarn. With regard to changes in texture, preferably, the needle cam and/or the sinker cam are raised or lowered to change the diameter of the interlocking area and/or the reduction length of the needles so as to change the texture.

In the lily yarn machine according to the present invention, plural needles and sinkers are arranged along the outer surface of a virtually conical cylinder and are controlled by a needle cam and a sinker cam, respectively; these cams are raised or lowered to change the diameter of the interlocking area at the top of the sinkers and the reduction length of the needles, respectively, to adjust the texture of the lily yarn. The change in the diameter of the interlocking area allows the change in the thickness of the raw yarn. The diameter of the interlocking area is increased for a thicker raw yarn so that the lily yarn can pass through the interlocking area. Sinkers can be operated by the sinker cam in coordination with the needles to reduce the strokes of the needles and, in turn, to increase the knitting speed of the lily yarn.

The needles may be compound needles comprising needle stems and sliders. The sliders can be controlled by a slider cam to further reduce the strokes of the needles and improve the knitting speed of the lily yarn.

EMBODIMENTS

Figure 1:
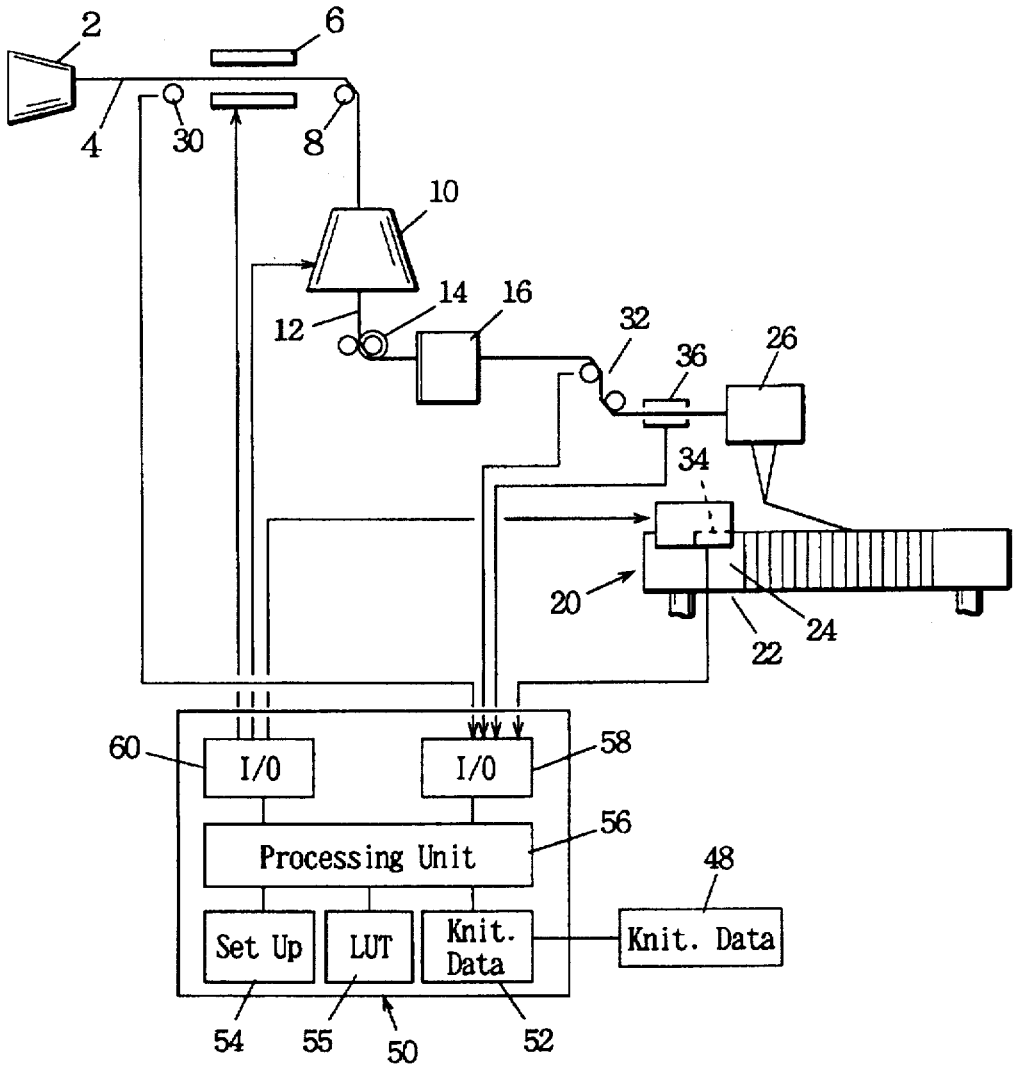
FIG. 1 is a diagram showing the configuration of the apparel system of the embodiment.

The embodiments and its modification are shown in FIG. 1 through FIG. 9. The overall configuration of apparel system of the first embodiment is shown in FIG. 1. In the diagram, 2 denotes a yarn package; for example, packages of three kinds of raw yarns, a fine yarn, a medium yarn and a coarse yarn, are provided. 4 denotes a raw yarn for the lily yarn, and the raw yarn is being drawn out of the yarn package 2. 6 is a dyeing machine of bubble jet type, ink jet type, etc. The raw yarn 4, which has been dyed by the dyeing machine 6, is fed, via a roller 8, into a lily yarn machine 10 to knit it into a lily yarn 12. The knitted lily yarn 12 is passed over a take down roller 14 and stored in a reservoir 16, which is in the form of a drum, etc. and is provided with a rotary encoder for measuring length; the lily yarn 12 is fed into the reservoir at one end thereof, and the lily yarn 12 is fed from the other end thereof into a flat knitting machine 20. In place of the flat knitting machine 20, other knitting machines such as a circular knitting machine and a warp knitting machine may used. A flat knitting machine 20, however, is preferred, which is suited to production of varied products in small quantities. 22 denotes a needle bed of the flat knitting machine 20; it denotes one of, for example, a pair of needle beds provided for the flat knitting machine. 24 is a carriage of the flat knitting machine 20, and 26 is a yarn feeder which feeds the lily yarn 12. Plural lily yarn machines 10 may be connected to one flat knitting machine 20 and a knotter or the like may be arranged between the reservoir connected to the respective lily yarn machines 10 and the yarn feeder 26.

To control the dyeing machine 6, the lily yarn machine(s) 10 and the flat knitting machine 20, a rotary encoder 30 is used to detect the feed of the raw yarn to the dyeing machine 6, and a rotary encoder stored in the reservoir 16 and a rotary encoder 32 are used to detect the input to and the output of the reservoir 16, respectively. The rotary encoders 30 and 32 are attached to the feed rollers of the raw yarn 4 and the lily yarn 12 to measure the lengths of the raw yarn 4 and the lily yarn 12 from the rotations of the rollers, respectively. An encoder 34 detects the position of the carriage 24; the encoder 34 detects the position of the carriage 24 from, for example, the rotation of the motor for belt driving the carriage 24. A color image sensor 36 detects the color and thickness of the lily yarn 24. This sensor 36 may be a sensor that can detect, at least, the color of the lily yarn 12, or the sensor 36 may be omitted. The color image sensor is provided near the carriage 24 inside the flat knitting machine 20, for example, near the yarn feeder.

Figure 2:
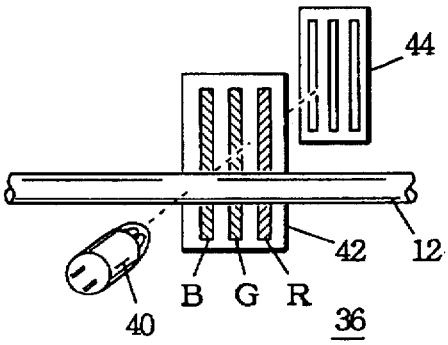
FIG. 2 is a perspective view of the imaged sensor used in the embodiment.

The configuration of the color image sensor 36 is shown in FIG. 2. Light is emitted from, for example, a light source 40 to the lily yarn. The reflected light is subjected to color separation, and the separated lights are detected by an CCD array 44 comprising three rows of photo-sensing elements corresponding to R, G and B. This arrangement can detect the thickness of the lily yarn 12 as well as the color thereof. The color image sensor 36 is not limited to that described in FIG. 2. For example, three LEDs of R, G and B may be used as light sources. These LEDs are lit up alternately, one at a time, and the reflected light is detected by, for example, a CCD array having only a single row of photo-sensing element.

48 is a secondary memory such as a floppy disc in which knitting data required for the control of the flat knitting machine 20 is stored. 50 is a controller that controls the entirety of the apparel system comprising the flat knitting machine 20, the dyeing machine 6 and the lily yarn machine 10. The controller 50 receives the knitting data for the fabric from the secondary memory 48 and stores the knitting data in a knitting data storage 52. The knitting data is processed by a processing unit 56 to determine the kinds of lily yarns 12 required. According to this, the set up unit 54 sets up the texture and color of each kind of lily yarn 12. 55 is a look up table and stores data for converting the length of the lily yarn into the length of the raw yarn 4. The table 55 also stores conversion data for the respective knitting conditions such as the heights of the needle cam and the sinker cam of the lily yarn machine 10 which will be described later. An input interface 58 receives signals from the encoders 30, 32 and 34 and signals from the sensor 36, and the processing unit 56, according to these signals, determines the feed speed of the raw yarn 4 to the dyeing machine 6, the production speed of the lily yarn 12 in the lily yarn machine 10, the reserved length of the lily yarn 12 in the reservoir 16, the current position of the carriage 24, the color of the lily yarn, etc. According to these data, the control interface 60 controls the feed of the raw yarn 4 to the dyeing machine 6 and controls the dyeing machine 6, the lily yarn machine 10, the carriage 24, etc.

Figure 3:
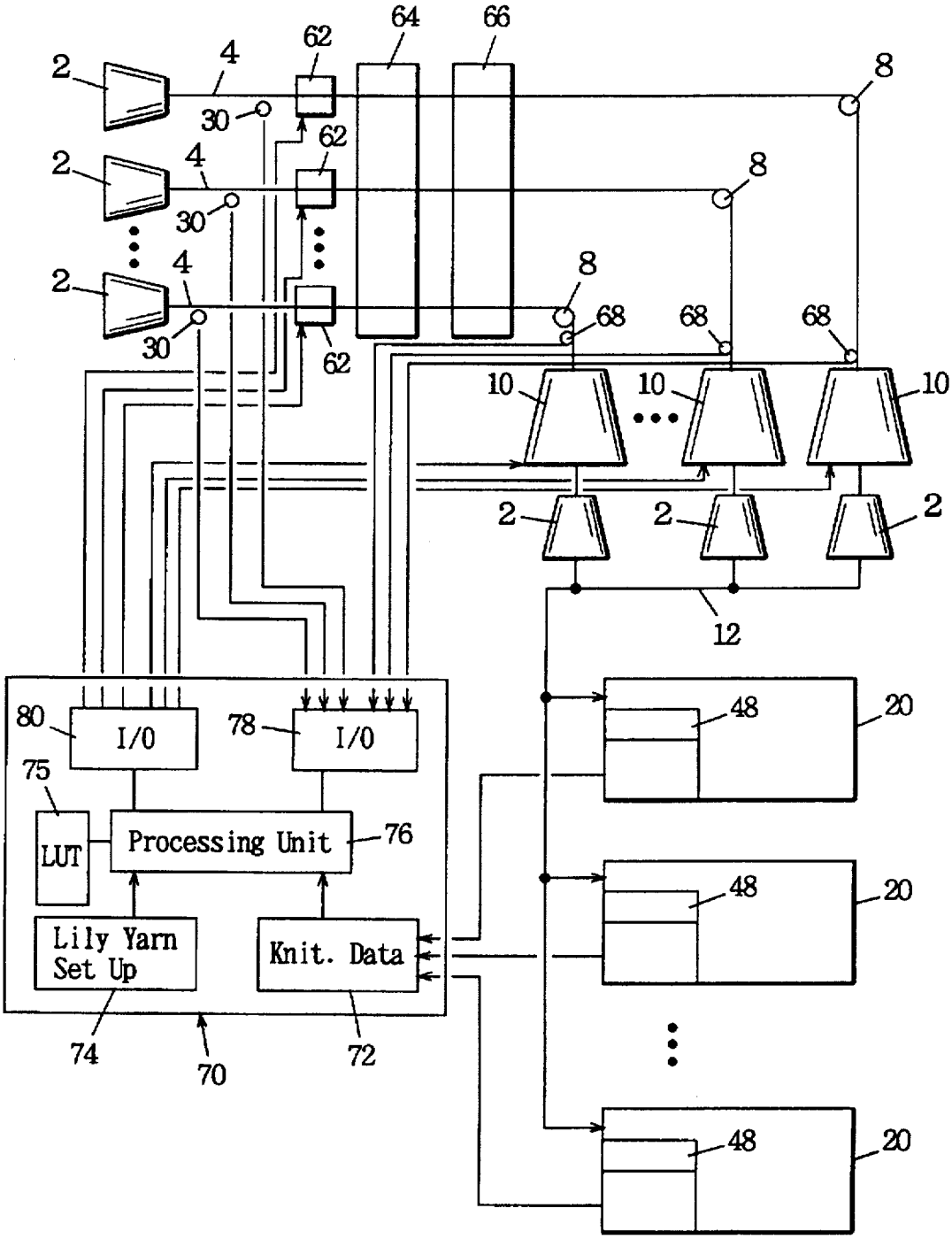
FIG. 3 is a diagram showing the configuration of the apparel system of the modification.

A modification of the apparel system is shown in FIG. 3. It differs from the embodiment of FIG. 1 in that the lily yarn machine 10 and the flat knitting machine are not directly connected to each other and that several lily yarn machines 10 and several flat knitting machines 20 are provided. As shown in the diagram, yarn packages 2 are used to feed, manually or via a transfer machine or the like provided overhead in a plant, the lily yarns 12 from the lily yarn machines 10 to the flat knitting machines 20. Without using packages 2, the lily yarns 12 may be fed directly from the lily yarn machines 10 to the flat knitting machines 20. The production speed of lily yarn in the lily yarn machines 10 are generally slower than the knitting speed of the flat knitting machines, a greater number of lily yarn machines 10 are provided than the flat knitting machines.

In FIG. 3, 62 denotes a dyeing head of the ink jet type, bubble jet type, etc. The raw yarns 4 are processed in a steamer 64 to develop color and washed in a washer to complete dyeing. A large number of dyeing heads 62 are provided, but the steamer 63 and the washer are used commonly; facilities that can be used commonly are used in that way. 68 denotes a rotary encoder that monitors the feed speed of the raw yarn 4 to each lily yarn machine 10. 70 is a controller of the entire system. This controller 70 is similar to the controller 50 of FIG. 1 and receives the knitting data from the second memories 48 in the floppy disc drives of the respective flat knitting machines 20, stores the knitting data in a knitting data storage 72, determines, in the processing unit 76, the required quantities and kinds of lily yarns from the numbers of knitting fabrics to be produced and the knitting data for the respective knitting fabrics, sets up, in the knitting data storage, the texture and color of each kind of lily yarn 12, and converts, in the look up table 75, the length of lily yarn 12 into the length of the raw yarn 4. The controller 70 receives input concerning the state of operation of the system by an input interface 58 to control the dyeing heads 62 and the lily yarn machines 10.

Figure 4:
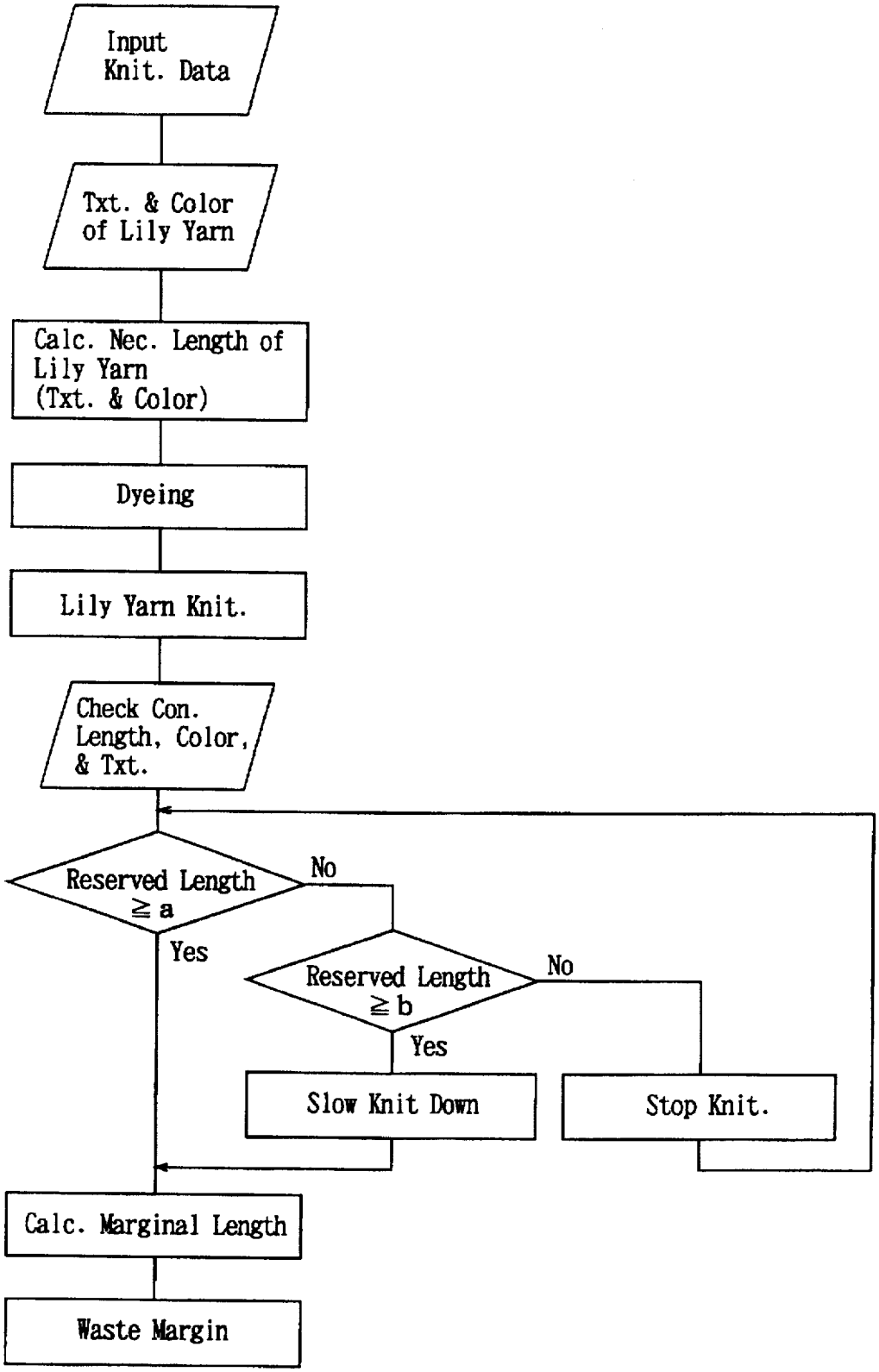
FIG. 4 is a process chart of knitting by the embodiment.

The operation of the embodiment is shown in FIG. 4. When the knitting data is inputted into the controller 50, the controller 50 will determine, from the inputted data, the number of kinds of lily yarns 12 and the necessary lengths of the respective kinds thereof, and allocate the texture, color, etc. to the respective kinds of lily yarns 12. The length of lily yarn can be converted into the length of raw yarn according to the look up table 55, thus the length of the necessary raw yarn 4 for each kind of lily yarn 12 can be determined. The raw yarn 4 is dyed by the dyeing machine 6, knitted by the lily yarn machine 10 into a lily yarn 12 and fed into the flat knitting machine 20. For example, three kinds of raw yarns 4, a fine yarn, a medium yarn and a coarse yarn, are procured and dyed by the dyeing machine 6 according to the color patterns of the knitting fabric, and the color is changed according to the knitting data. In a similar manner, the texture of the lily yarn 12 can be modified according to the knitting data. Let us consider a turning point of color of the lily yarn 12. If, for example, the loop length of the lily yarn 12 is 10 mm and six strokes are needed, the length of the raw yarn for one course (6 strokes) of the lily yarn will be about 6 cm; an error of 6 cm in the dyeing position is reduced to an error of one course in the lily yarn 12.

In the embodiment of FIG. 1, if the reserved length of the lily yarn 12 in the reservoir 16 is reduced excessively, it may result in lily yarn break. The lengths of the lily yarn passed are determined by the rotary encoder stored in the reservoir 16 and by the rotary encoder 32, respectively, and from the difference between the two lengths, the reserved length of the lily yarn 12 is determined. If the reserved length is, for example, a value a or greater, the knitting will be made without any restriction on the flat knitting machine 20. If the reserved length is reduced below a, the knitting speed will be reduced, and if the reserved length is reduced below another value b, the knitting will be suspended to wait for an increase in the reserved length.

The loop length of the fabric on the flat knitting machine 20 is monitored by the rotary encoder 32, and feedback control is given to the carriage 24 to bring the loop length to the desired length. The accumulation of the loop lengths shows the consumed length of the lily yarn and also shows which part of the lily yarn is used for which stitch. Hence, one can see which portion of the lily yarn must be dyed with which color to give the desired color to each stitch. The conversion between the lily yarn length and the raw yarn length is made according to the data of the look up table 55. In this way, dyeing is made by the dyeing machine 6 at the desired positions.

When the texture and color of the lily yarn 12 being fed to the flat knitting machine 20 are detected by the color image sensor 36, the cumulative errors of the rotary encoders 30, 32, etc. can be eliminated. In other words, when the actual texture and/or color is used as marks made on the lily yarn and detected by the sensor 36, one can see which portion of the lily yarn knitted was used by the flat knitting machine at which time point. From this, one can check and verify that the cumulative error is within the tolerance. For example, a small margin may be added to the feed of the lily yarn 12 required for knitting of some fabrics. The margin portion is processed by waste course knitting, and the length for waste course knitting is adjusted according to the cumulative error. Naturally, the margin may be eliminated from the beginning.

Figure 5:
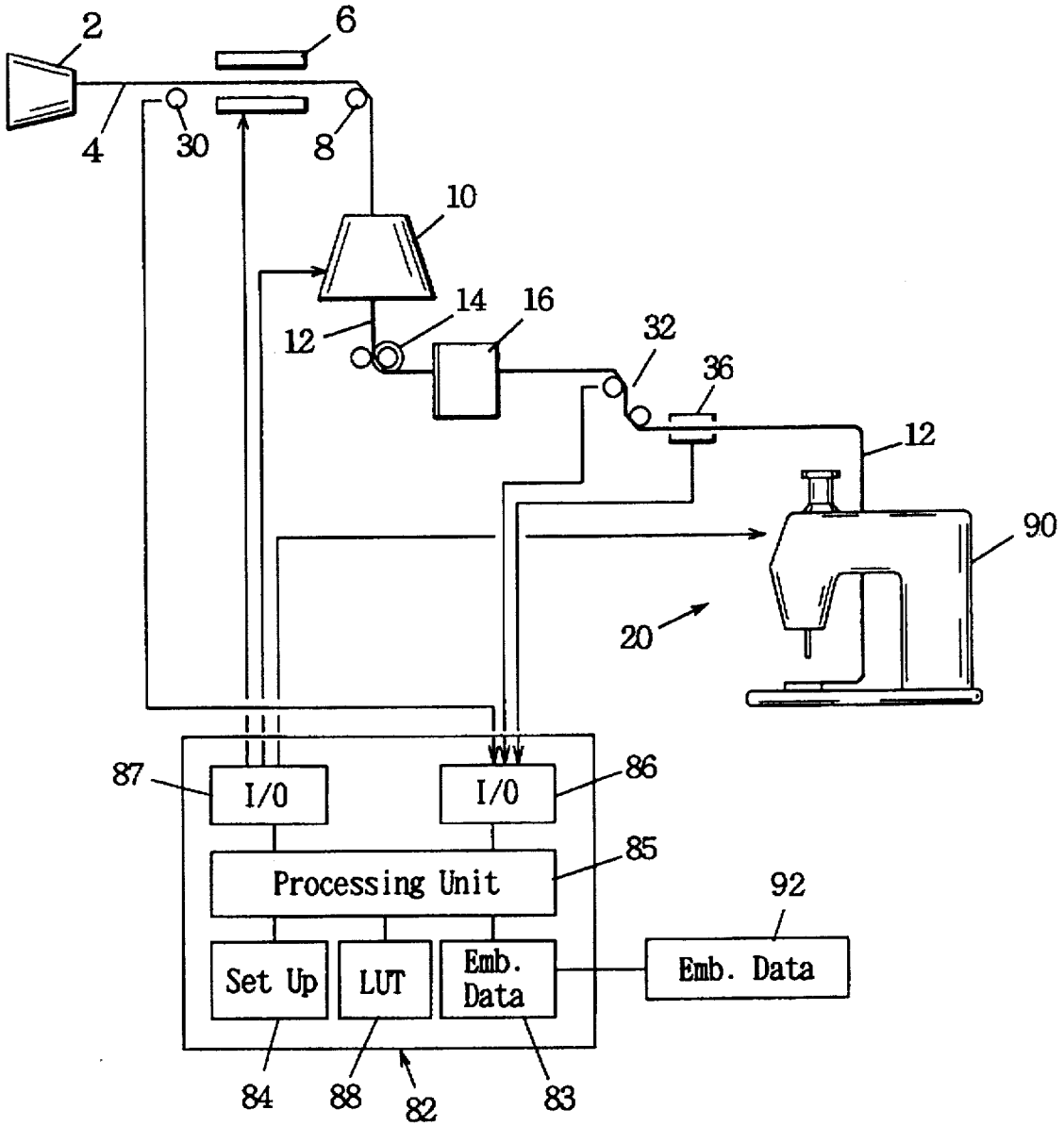
FIG. 5 is a diagram showing the configuration of the apparel system of the second embodiment.

In the embodiment described to this point, the application to a knitting machine has been described. The produced lily yarn, however, can be used for sewing, for example, as cords for cording with an embroidery machine. Such an embodiment is shown in FIG. 5. In the diagram, 82 is a new controller, 83 is embroidery data storage, 84 is a set up unit for texture, etc. of the lily yarn 12, 85 is a processing unit, 86 is an input interface, 87 is a control interface, 88 is a look up table for converting the lily yarn length into the raw yarn length, 90 is an embroidery head, and 92 is a secondary memory such as a floppy disc storing the embroidery data. The embroidery data storage 83 determines, according to the embroidery data received from the secondary storage 92, the kinds and lengths of lily yarns 12 required, and the set up unit 84 sets up the color and texture for each kind of lily yarn 12. A processing unit 85 controls a control interface 87 according to these data and the data from the input interface 86 to control the dyeing machine 6 and the lily yarn machine 10 so that the desired length of the lily yarn 12 with the desired texture and color is fed to the embroidery head 90, and to control the embroidery head 90 to embroider the fed lily yarn 12 as cord. The consumption speed of the lily yarn 12 by the embroidery head 90 is lower than the production speed of the lily yarn 12 by the lily yarn machine 10. Hence plural embroidery heads 90 may be connected to one lily yarn machine 10, and the reservoir 16 may be eliminated.

The control algorithm of the embodiment shown in FIG. 5 is similar to that of FIG. 4. However, as the consumption speed of the lily yarn 12 by the embroidery head 90 is low, the step of monitoring the reserved length in FIG. 4 is not required. Moreover, the calculation of the margin and the processing of the margin are not required.

Figure 6:
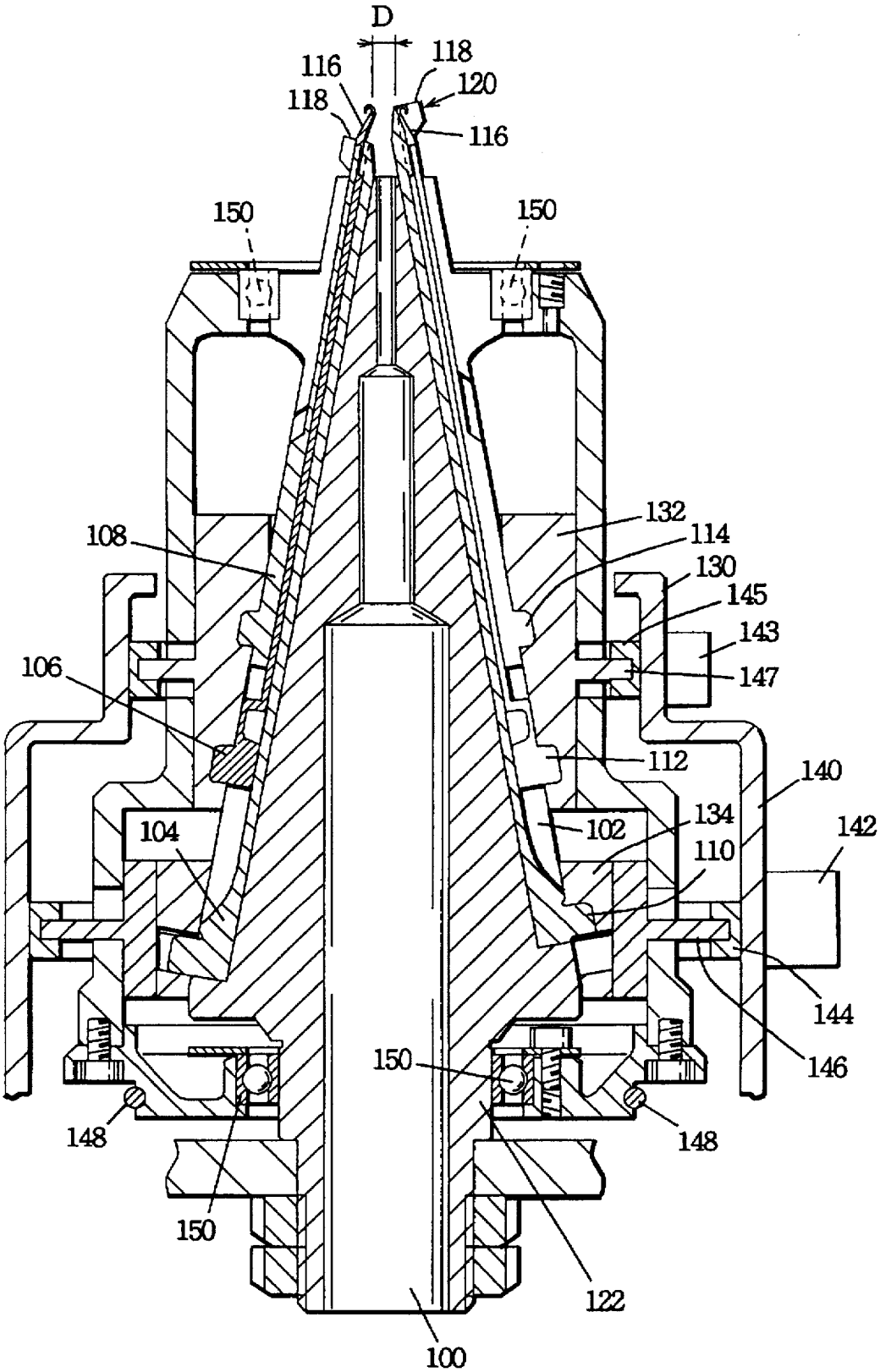
FIG. 6 is a partial sectional view of the lily yarn machine used in the embodiments.
Figure 7:
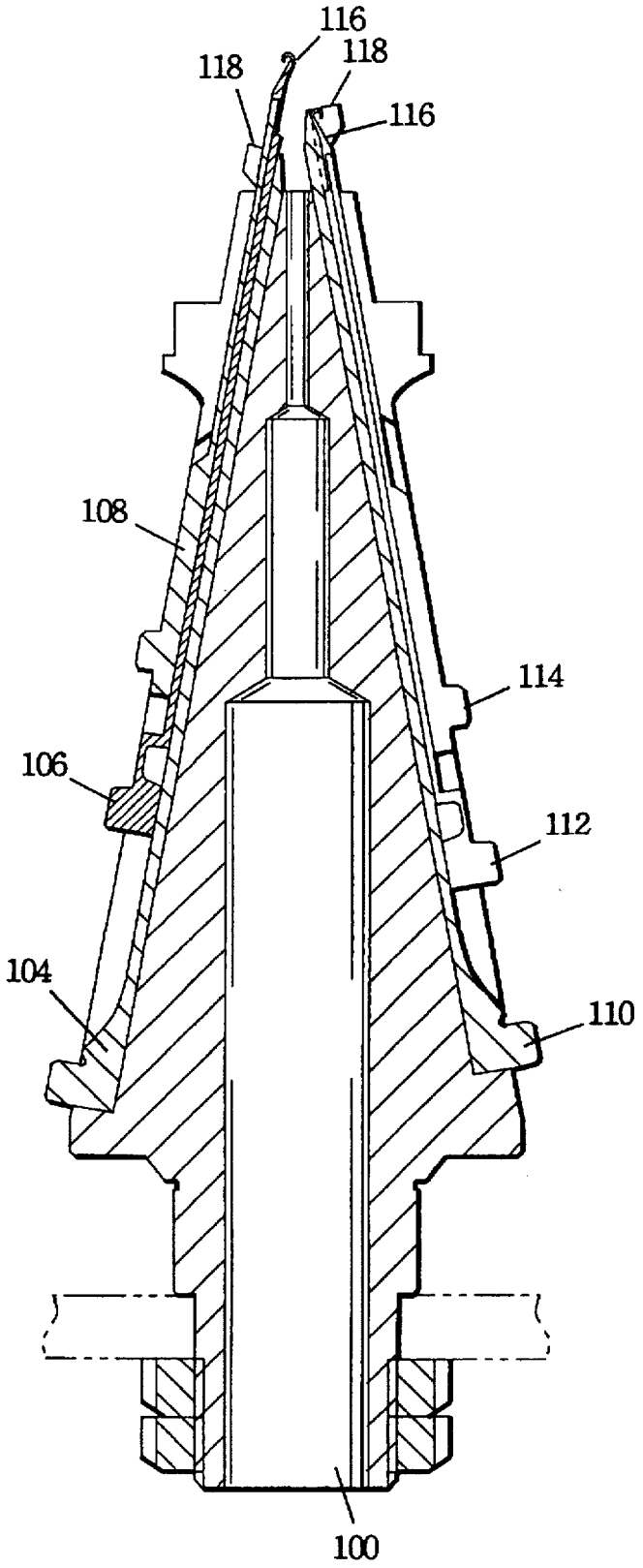
FIG. 7 is a sectional view of the cylinder block of the lily yarn machine used in the embodiments.

The lily yarn machine 10 used in the embodiment is shown in FIG. 6 and FIG. 7. FIG. 6 shows the state with a rotating outside cylinder 130, etc. being set in position, and FIG. 7 shows the state with these components having been removed. In these diagrams, 100 is a virtually conical cylinder from which a portion near the apex of the cone is cut away. Plural grooves 102 are made in the outer surface of the cylinder 100, and sinkers 104 are stored in the grooves 102. Sinkers 104 have, for example, a U-shaped section; needle stems 106 and sliders 108 of compound needles are arranged in the U-shaped grooves. The use of compound needles is for enhancing the knitting speed of the lily yarn 12. Latch needles may be used. 110 are sinker butts, 112 are needle butts, 114 are slider butts, 116 are hooks provided at the top end of the needle stems 106, and 118 are tips at the top end of the sinkers 104. The numbers of the sinkers 104, the needle stems 106, etc. are, for example, from six to ten. The sinker tips 118 are arranged to form a ring, and these sinker tips 118 form an interlocking area 120. The diameter of the interlocking area 120 is D shown in FIG. 6. The cylinder 100 has a cavity 122 therein, and the knitted lily yarn 12 is taken down by the take down roller 14, etc. 132 is a needle cam for driving the needle stems 106 and the sliders 108. 134 is a sinker cam, 140 is a fixed outside case, and 142 and 143 are stepping motors. 144 and 145 are fitting parts which are fitted onto ring-like projections mounted on the sinker cam 134 and the needle cam 132 to vertically move the sinker cam 134 and the needle cam 132. 148 is a driving belt for rotating the rotating outside cylinder 130 and cams 132 and 134. A ball bearing 150 is used to make the cams 132 and 134 freely rotatable relative to the cylinder 100. In the embodiment, the cams 132 and 134 are rotated, the cylinder 100, however, may be rotated. One or plural yarn feeders are provided but they are not illustrated. Provision of a larger number of yarn feeders will increase the production speed of the lily yarn 12. The sinker cam 134 and the needle cam 132 are moved vertically by the stepping motors 142 and 143, respectively. These cams, however, may be moved vertically in an integrated manner.

Figure 8:
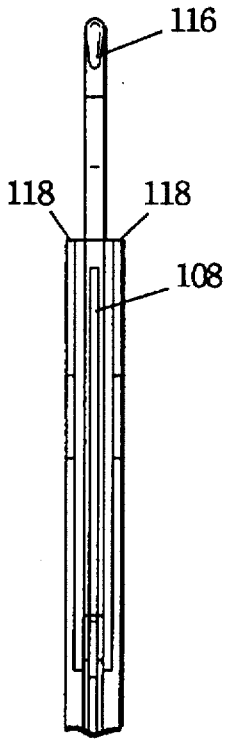
FIG. 8 is a partial front view of the sinker of the lily yarn machine used in the embodiments.
Figure 9:
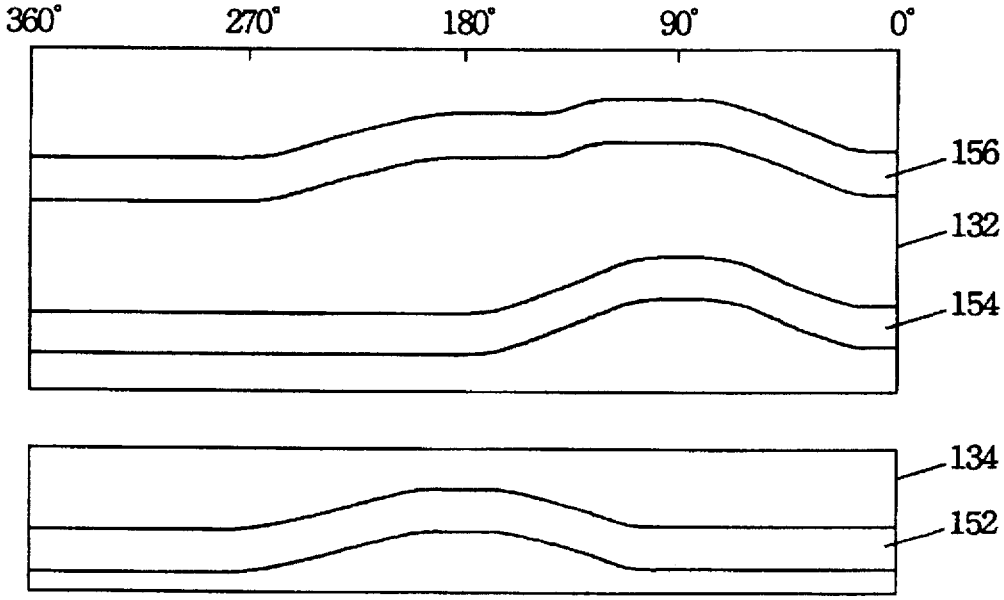
FIG. 9 is a development view of the cams of the lily yarn machine used in the embodiments.

A portion around the hook 116 is shown in FIG. 8. The top end of the sinker tip 118 is, for example, U-shaped. The configuration of the needle cam 132 and the sinker cam 134 is shown in FIG. 9. 152 is the guide for the sinker cam 134 and engages with the sinker butts 110 to drive the sinkers 104. 154 is the needle cam guide and engages with the needle butts 112 to drive the needle stems 106. 156 is the slider cam guide and engages with the slider butts 114 to drive the sliders 108. They are stored inside the rotating outside cylinder and rotated by the driving belt 148. The phases of the respective cam guides 152 through 156 are shifted, and the strokes of the needle stems 106 are made smaller by moving the sliders 108 with the slider cam guide 156, and in turn, the knitting speed of the lily yarn 12 is increased. The phase of the sinker cam guide 152 is shifted by about 90 degrees relative to that of the needle cam guide 154; the movement of the sinker tips 118 relative to the hooks 116 further reduces the strokes of the needle stems 106. As the sinker tips 118 move upwards when the hooks 116 move downwards, the vertical strokes of the hooks 116 can be reduced to about one half.

The sinker cam 134 and the needle cam 132 can be moved vertically along the outer surface of the cylinder 100; the fitting parts 144 and 145 are moved vertically by the stepping motors 142 and 143 to vertically move the cams 132 and 134 via the ring-like projections 146 and 147. According to these movements, the interlocking area diameter D and the reduction length of the hooks 116 are changed to modify the texture of the lily yarn 12. Furthermore, the texture of the lily yarn 12 can be modified by changing the number of needles of the lily yarn machine 10 or the take down force of the take down roller 14. For example, if the interlocking area diameter is increased or the reduction length of the hooks 116 is increased, the course length of the lily yarn 12 or the loop length will be increased; this results in a finer and softer lily yarn. Reversely, if the interlocking area diameter is reduced or the reduction length is reduced, the resulting lily yarn will be harder and a rather coarse lily yarn. Change of the interlocking area diameter is also effective in changing the kinds of raw yarns. The interlocking area diameter is increased for a coarse raw yarn to assure smooth passage of the lily yarn 12 through the interlocking area. If the number of needles is changed, the number of stitches per unit length of the lily yarn 12 will change together with the texture thereof.

I claim:

1. An apparel system comprising:

a lily yarn machine for knitting lily yarns;

a flat knitting machine having at least two needle beds for knitting according to knitting data; and a controller connected to said lily yarn machine and said flat knitting machine for controlling said lily yarn machine to produce lily yarn in a quantity required by said flat knitting machine according to said knitting data for said flat knitting machine.

2. An apparel system of claim 1, further comprising:

a reservoir for reserving said lily yarn, one end of said reservoir being connected to the said lily yarn machine and the other end thereof being connected to said flat knitting machine.

3. An apparel system of claim 2, further comprising:

a means connected to said controller for determining the reserved length of said lily yarn in said reservoir; and a means provided in said controller and coupled to said flat knitting machine for controlling the knitting speed of said knitting machine according to the reserved length thus determined.

4. An apparel system of claim 1, wherein said lily yarn is knitted from raw yarn by said lily yarn machine, and further comprising a dyeing machine for controlling said raw yarn for said lily yarn, said dyeing machine being controlled by said controller according to said knitting data of said flat knitting machine.

5. An apparel system of claim 4, further comprising a sensor coupled to said flat knitting machine to detect a color of said lily yarn.

6. An apparel system of claim 1, further comprising a knotter coupled to said lily yarn machine for joining raw yarns of different materials of said lily yarn and feeding them to said lily yarn machine.

7. An apparel system of claim 4 further comprising a knotter coupled to said lily yarn machine for joining raw yarns of different materials of said lily yarn and feeding them to said lily yarn machine.

8. An apparel system of claim 1 further comprising a means for controlling texture provided to said lily yarn machine to control the texture of said lily yarn.

9. An apparel system comprising:

a lily yarn machine for knitting lily yarns;

a flat knitting machine having at least two needle beds for knitting according to knitting data;

a controller connected to said lily yarn machine and said flat knitting machine for controlling said lily yarn machine to produce lily yarn in a quantity required by said flat knitting machine according to said knitting data for said flat knitting machine; and means for controlling texture provided to said lily yarn machine to control the texture of said lily yarn, wherein said lily yarn machine comprises a conical cylinder, plural sinkers and needles being arranged along an outer surface thereof, a sinker cam coupled to said sinkers and a needle cam coupled to said needles for controlling said sinkers and needles, respectively, and wherein said means for controlling texture comprising a means for vertically moving said sinker cam and said needle cam along said outer surface of said cylinder.

* * * * *